United States Patent [19]

Havel

[11] Patent Number: 4,716,263

[45] Date of Patent: Dec. 29, 1987

[54] RECIPROCALLY ACTUATED SWITCH WITH ROTATABLE CONTACT SELECTOR

[76] Inventor: Karel Havel, P.O. Box 66, Station M, Toronto, Ontario, Canada, M6S 4T2

[21] Appl. No.: 65,901

[22] Filed: Jun. 24, 1987

Related U.S. Application Data

[63] Continuation-in-part of Ser. No. 901,878, Aug. 29, 1986, abandoned, which is a continuation-in-part of Ser. No. 852,768, Apr. 16, 1986, abandoned, which is a continuation-in-part of Ser. No. 844,690, Mar. 27, 1986, abandoned.

[51] Int. Cl.[4] ..... H01H 19/00; H01H 21/00; H01H 25/06

[52] U.S. Cl. ..... 200/11 R; 200/16 R

[58] Field of Search ..... 200/6 R, 6 B, 8 R, 8 A, 200/11 R, 11 B, 11 E, 11 EA, 57.09, 51.1, 61.76–61.79, 153 L, 153 LA155 R, 155 A, 159 A, 160, 243, 244, 330, 336, 156; 439/259, 682, 725, 836, 837

[56] References Cited

U.S. PATENT DOCUMENTS

| | | | |
|---|---|---|---|
| 1,636,347 | 7/1927 | Woodroof | 200/11 EA |
| 3,470,334 | 9/1969 | De Robertis et al. | 200/11 R |
| 3,590,176 | 6/1971 | Laserson et al. | 200/156 X |
| 3,975,601 | 8/1976 | Whelan | 200/11 R |
| 4,052,580 | 10/1977 | Stanish | 200/243 X |

*Primary Examiner*—J. R. Scott

[57] ABSTRACT

A rotary switch comprises a rotary member with a flexible conducting bridging element which may be rotated to aligned position with a selective one of contact pairs angularly arranged on a stationary member. A slider is arranged on the rotary member for reciprocating movement to engage and disengage the bridging element with the contact pair in the aligned position.

6 Claims, 13 Drawing Figures

FIG. 3
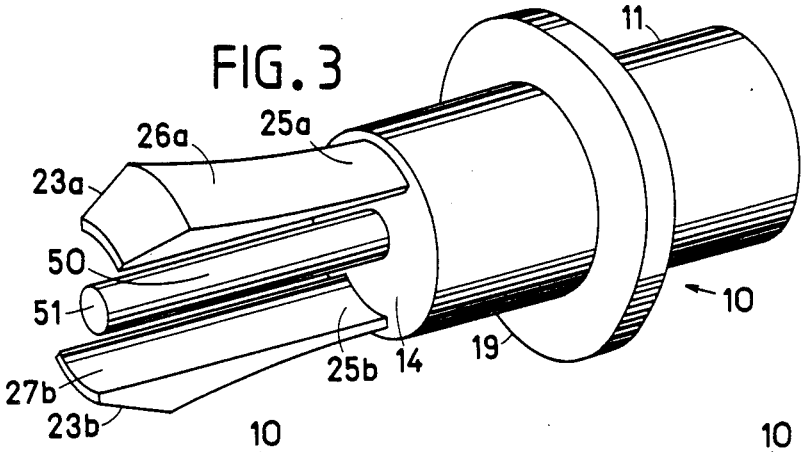
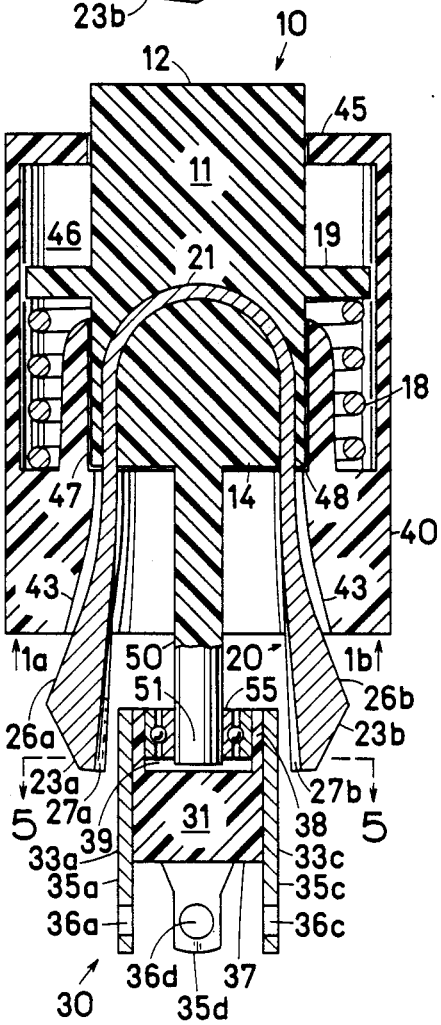
FIG. 1
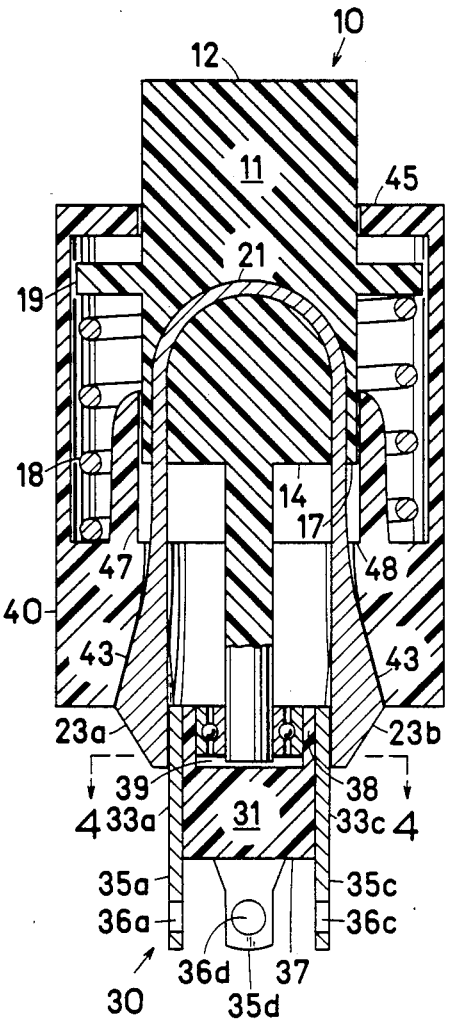
FIG. 2

FIG. 10
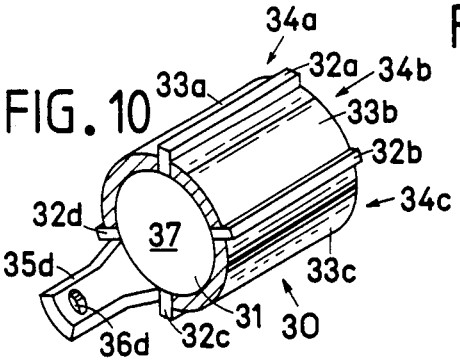
FIG. 11
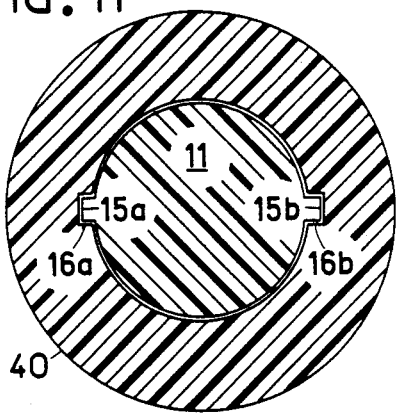
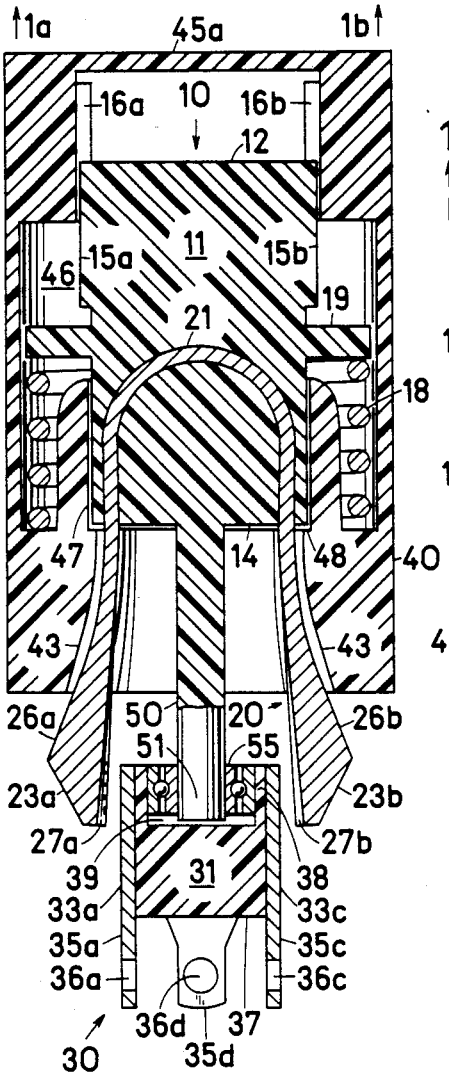
FIG. 12
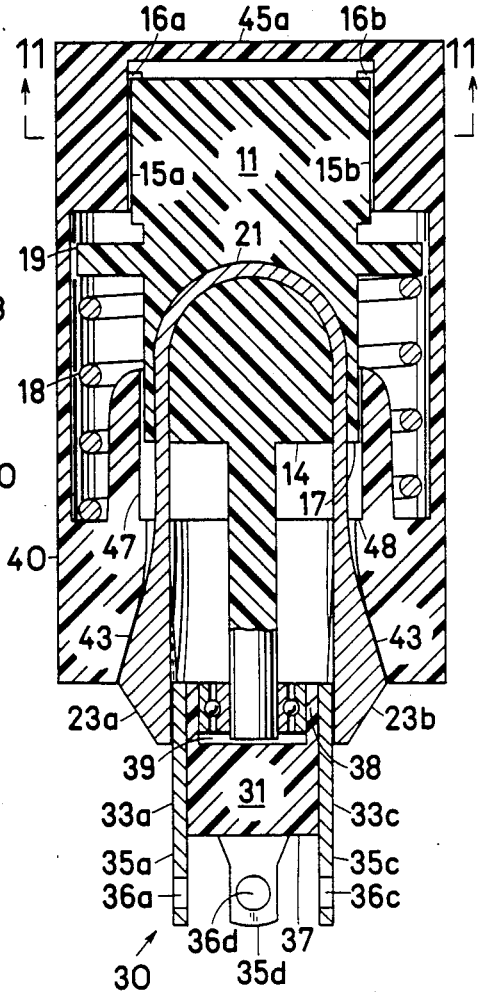
FIG. 13

RECIPROCALLY ACTUATED SWITCH WITH ROTATABLE CONTACT SELECTOR

CROSS-REFERENCE TO RELATED APPLICATIONS

This is a continuation-in-part of my application Ser. No. 06/901,878 filed on Aug. 29, 1986 and entitled Rotary Switch, abandoned, which is a continuation-in-part of my application Ser. No. 06/852,768 filed on Apr. 16, 1986 and entitled Zero Force Rotary Switch, abandoned, which is a continuation-in-part of my application Ser. No. 06/844,690 filed on Mar. 27, 1986 and entitled Electrical Zero Insertion Force Connector, abandoned.

BACKGROUND OF THE INVENTION

1. Field of the Invention

This invention generally relates to electrical switches and more specifically to a rotary switch with reciprocating slider.

2. Description of the Prior Art

Presently known rotary switch usually includes a shaft rotatably mounted in a suitable housing, a plurality of circumferentially spaced stationary contacts, and a wiper associated with the shaft for wiping engagement with the contacts. Rotation of the shaft selectively makes and breaks electrical connections between the contacts in accordance with its rotary position.

Such rotary switch has a disadvantage in requiring a considerable rotary force to rotate it from one contacting position to another. Another disadvantage is in the necessity to connect and disconnect the contacts in the same sequence.

SUMMARY OF THE INVENTION

In a broad sense, it is the principal object of this invention to provide a new type of a rotary switch that is extremely simple in construction and efficient in operation.

It is another object of the invention to provide a rotary switch with reciprocating slider.

It is still another object of the invention to provide a rotary switch that can be rotated by exerting a relatively low rotary force.

It is still another object of the invention to provide a rotary switch in which the contacts may be connected and disconnected in any sequence.

The rotary switch of the present invention includes rotatably coupled stationary and rotary members. The rotary member includes a flexible U-shaped conducting bridging element having at its ends two integral jaws. By moving a slider axially arranged on the rotary member, the jaws may be brought into and out of electrical engagement with a contact pair in the aligned position on the stationary member. When the slider is away from its engaging position, the rotary member may be selectively rotated to bring the bridging element into aligned position with another contact pair.

Further objects of the invention wil become obvious from the accompanying drawings and their description.

BRIEF DESCRIPTION OF THE DRAWINGS

In the drawings in which are shown the preferred embodiments of the invention,

FIG. 1 is a cross-sectional view revealing internal structure of a rotary switch of this invention in its disengaged condition.

FIG. 2 is a cross-sectional view of a like rotary switch in its engaged condition.

FIG. 3 is a perspective view of a rotary member of the rotary switch.

FIG. 10 is a perspective view of a stationary member of the rotary switch.

FIG. 11 is a cross-sectional view, taken along the line 11—11 in FIG. 13, revealing the engagement of flanges on the rotary member and grooves in the slider.

FIG. 12 is a cross-sectional view revealing internal structure of another embodiment of a rotary switch in its disengaged condition.

FIG. 13 is a cross-sectional view of a like rotary switch in its engaged condition.

Throughout the drawings, like characters indicate like parts.

DESCRIPTION OF THE PREFERRED EMBODIMENTS

Figure 4:
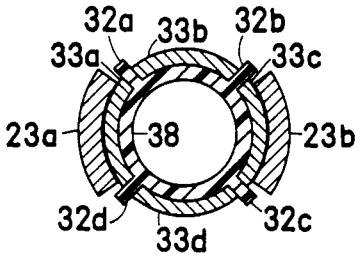
FIG. 4 is a cross-sectional view of the rotary switch of FIG. 2, taken along the line 4—4, showing the detail of engaged jaws in the first rotary position.

Referring now, more particularly, to the drawings, in FIGS. 1 to 3 is shown a rotary switch of the invention which includes a rotary member 10 and stationary member 30. Generally, the rotary switch has two conditions: engaged one, illustrated in FIG. 2, in which rotary member 10 is in engagement with stationary member 30 and cannot be rotated, and disengaged one, illustrated in FIG. 1, in which rotary member 10 is out of engagement with stationary member 30 and may be rotated to another rotary position. As will be pointed out more specifically below, slider 40 serves to engage and disengage the rotary switch.

Elongated rotary member 10, extending along a vertical longitudinal axis, is comprised of a generally cylindrical insulating body 11, with top 12 and bottom 14, and a conductive U-shaped bridging element 20, secured in body 11 by having its U-bend portion 21 axially anchored, having at its ends symmetrically disposed integral gripping jaws **23*a* and 23*b* with resiliently flexible portions 25*a* and 25*b*, respectively, viewed in FIG. 3. Jaws 23*a* and 23*b* normally extend at an angle with respect to the vertical axis, as illustrated in FIG. 1. Respective jaws 23*a* and 23*b* have abutting surfaces 26*a* and 26*b* formed on their outer convex faces and contacting surfaces 27*a* and 27*b*** formed on their inner concave faces.

Stationary member 30 is comprised of an insulating cylindrical body 31 having at its surface secured four axially extending stationary contacts **33*a*, 33*b*, 33*c*, and 33*d* arranged substantially equally spaced from each other to form diametrical contact pairs 33*a*, 33*c* and 33*b*, 33*d*. The other ends of contacts 33*a*, 33*b*, 33*c*, and 33*d*, adjacent bottom 37, are respectively provided with electrical terminals 35***a*, 35*b* (not shown but opposite to terminal 35*d*), 35*c*, and 35*d* with apertures 36*a*, 36*b* (not shown but similar to aperture 36*d*), 36*c*, and 36*d* for joining conductors thereto.

A shaft 50, integral with rotary body 11 and axially extending from its bottom 14, has its lower end 51 secured in inner race of a ball bearing 55 which has its outer race secured in a recess 39 formed in top 38 of stationary body 31. Rotary member 10 may be thus rotated with respect to stationary member 30, when the rotary switch is disengaged, by exerting a relatively low rotary force.

Tubular insulating slider 40 is arranged on rotary body 11 of rotary member 10 for reciprocating movement along the vertical axis to its engaging position towards jaws 23*a* and 23*b*, illustrated in FIG. 2, and to its disengaging position sufficiently away from jaws 23*a* and 23*b*, illustrated in FIG. 1. Slider 40 includes an overhanging portion 45, extending over spring stop 19 for internally defining annular spring cavity 46 and for limiting the travel of slider 40 over its engaging position. Annular abutting stop projection 48, adapted to engage stop projection 17 formed on bottom 14 of rotary body 11, is formed on slider 40 and serves to limit its travel away from its engaging position. Inwardly turned rim 47 is formed on slider 40 for allowing it to snugly slide to its engaging position on rotary body 11. A helical coil spring 18 surrounding rotary body 11 is anchored by its one end at annular spring stop 19 integrally formed on body 11 and has its other end applied to slider 40 for normally urging it to its engaging position.

Slider 40 has formed thereon annular abutting surfaces 43 sloped at an angle less than 30 degrees with respect to the vertical axis and adapted to engage complementary abutting surfaces 26*a* and 26*b* on jaws 23*a* and 23*b* and to transfer the force of spring 18 to jaws 23*a* and 23*b* and thence to contact pair 33*a*, 33*c* or 33*b*, 33*d*. When in its engaging position, slider 40 abuts jaws 23*a* and 23*b*, as illustrated in FIG. 2, to deflect same towards, and into intimate electrical engagement with, the contact pair 33*a*, 33*c* or 33*b*, 33*d* on stationary member 30, to complete the circuit continuity. When in its disengaging position, slider 40 disengages jaws 23*a* and 23*b*, as illustrated in FIG. 1, to release contact pair 33*a*, 33*c* or 33*b*, 33*d*. Consequently, to rotate the rotary switch to its another position, it is necessary to manually move slider 40 against the force of spring 18 and sufficient distance away from its engaging position, as indicated in FIG. 1 by arrows 1*a* and 1*b*.

It is contemplated that the best operating mode of the rotary switch is to rigidly secure stationary member 30, move slider 40 to its disengaging position, and rotate rotary member 10 to the desired rotary position. This can be accomplished either by holding slider 40 in its disengaging position with one hand and rotating rotary member 10 with the other hand, or by holding slider 40 and rotary member 10 together with three or four fingers and rotating them jointly.

Figure 5:
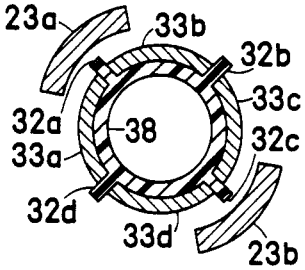
FIG. 5 is a cross-sectional view of the rotary switch of FIG. 1, taken along the line 5—5, showing the detail of jaws during the rotation.
Figure 6:
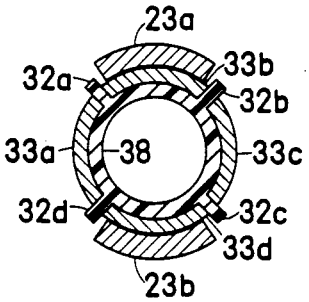
FIG. 6 is a cross-sectional view similar to FIG. 4 showing the detail of engaged jaws in the second rotary position.

FIGS. 4 to 6 show the details of engaged and disengaged contact pairs. In the first rotary position, viewed in FIG. 4, the contact pair 33*a*, 33*c* is electrically interconnected; in the second rotary position, viewed in FIG. 6, the contact pair 33*b*, 33*d* is interconnected. The portions of ball bearing 55 and shaft bottom 51 were omitted from FIGS. 4 to 6 so as not to obscure the drawings by unnecessary details.

As shown in FIG. 4, jaws 23*a* and 23*b* are in engagement with the contact pair 33*a*, 33*c*, and a continuous conducting path is established from terminal 35a, as viewed in FIG. 2, via contact 33*a*, jaw 23*a*, U-bend 21, jaw 23*b*, contact 33*c*, to terminal 35*c*. The contacts 33*a*, 33*b*, 33*c*, and 33*d* are physically separated by equiangularly spaced insulating ribs 32*a*, 32*b*, 32*c*, and 32*d*, respectively, best viewed in FIG. 10. There is a space between the sides of jaw 23*a* and sides of ribs 32*a* and 32*d* to allow jaw 23*a* to slightly slide sideways so as to provide a wiping action between jaw 23*a* and contact 33*a*, and, in a similar fashion between jaw 23*b* and contact 33*c*.

FIG. 5 illustrates the rotary switch in its disengaged condition showing how jaws 23*a* and 23*b* may be freely rotated from the first to second rotary position or vice versa.

As shown in FIG. 6, jaws 23*a* and 23*b* are in engagement with the contact pair 33*b*, 33*d*, and a continuous conducting path is established from terminal 35*b*, via contact 33*b*, jaw 23*a*, U-bend 21, jaw 23*b*, contact 33*d*, to terminal 35*d*.

It would be obvious to those skilled in the art that rotary switches having more than two contact pairs may be readily designed in accordance with the principles of the invention. It would be further obvious that such rotary switches may be so rotated as to interconnect the pairs of contacts in any desired sequence, without regard to their physical arrangement.

Figure 7:
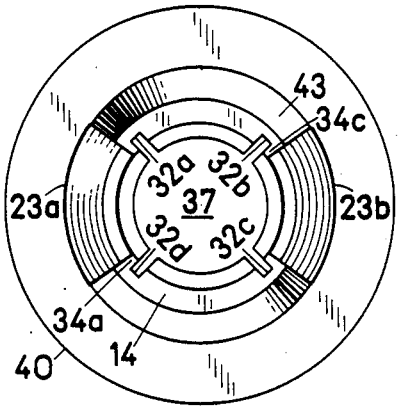
FIG. 7 is a bottom view of the rotary switch of FIG. 2 in its first rotary position.
Figure 8:
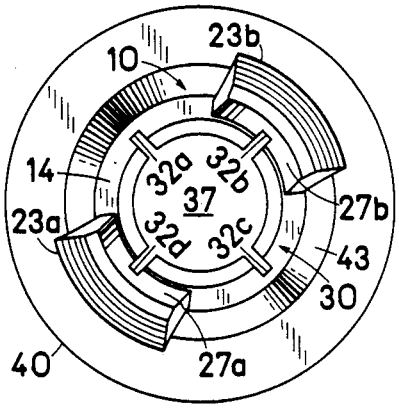
FIG. 8 is a bottom view of the rotary switch of FIG. 1 showing the progress of rotation of the rotary member with respect to the stationary member.
Figure 9:
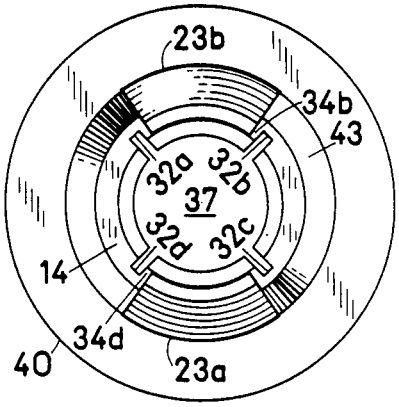
FIG. 9 is a bottom view similar to FIG. 7 of the rotary switch in its second rotary position.

FIGS. 7 to 9 are bottom views of the rotary switch of FIGS. 1 and 2 showing the progress of rotation of jaws 23*a* and 23*b*. The details of electrical terminals 35*a*, 35*b*, 35*c*, and 35*d* were omitted to render the illustration less complex.

In FIG. 7 is shown the rotary switch in the first rotary position. Ribs 32*a* and 32*d* define therebetween recess 34*a* for assuring the correct position of jaw 23*a*. In a similar fashion, ribs 32*b* and 32*c* define therebetween recess 34*c* for assuring the correct position of jaw 23*b*.

In FIG. 8 is shown the rotary switch in its intermediate position. When slider 40 is moved to its disengaging position, viewed in FIG. 1, its abutting surfaces 43 release jaws 23*a* and 23*b* to allow them to extend angularly to provide sufficient clearance from ribs 32*a*, 32*b*, 32*c*, and 32*d*. Rotary member 10 may be then rotated without obstruction to the second rotary position. During the rotation, bottom 14 of rotary member 10, with jaws 23*a* and 23*b* resiliently extending therefrom, rotates counterclockwise with respect to bottom 37 of stationary member 30.

When jaws 23*a* and 23*b* reach the aligned position with recesses 34*b* and 34*d* in the second rotary position, slider 40 may be released to its engaging position. Ribs 32*a* and 32*b* define therebetween recess 34*b* for assuring the correct position of jaw 23*b*. In a similar fashion, ribs 32*c* and 32*d* define therebetween recess 34*d* for assuring the correct position of jaw 23*a*.

In FIG. 10 is shown a perspective view of stationary member 30. Four insulating longitudinal ribs 32*a*, 32*b*, 32*c*, and 32*d* are axially secured on cylindrical surface of stationary body 31 and substantially equally spaced from each other. Ribs 32*a* and 32*b* define therebetween recess 34*b*, ribs 32*b* and 32*c* define therebetween recess 34*c*, ribs 32*c* and 32*d* define therebetween recess 34*d* (not shown but opposite to recess 34*b*), and ribs 32*d* and 32*a* define therebetween recess 34*a*. Contacts 33*a*, 33*b*, 33*c*, and 33*d* (not shown but similar to contact 33*b*) are respectively secured in recesses 34*a*, 34*b*, 34*c*, and 34*d* and provided with terminals 35*a*, 35*b*, 35*c*, and 35*d*, of which only terminal 35*d* is shown so as not to obscure the details of ribs 32*a*, 32*b*, 32*c*, and 32*d*.

In FIGS. 11 to 13 is shown a modified embodiment of the rotary switch of the invention in which rotary member 10 is constrained to rotate with slider 40. Since the bottom portion of the rotary switch is substantially same as viewed in FIGS. 1 and 2, it will be described only briefly. Rotary member 10 has on the opposite sides of its top portion 12 formed two flanges 15*a* and 15*b*, extending along the vertical axis for respectively slidably engaging vertical grooves 16*a* and 16*b* formed in the inner surface of slider 40. Slider 40 has its top portion 45*a* modified to completely overhang rotary member 10. To operate the rotary switch, slider 40 may be grasped wtih a thumb and forefinger and pulled up, as indicated by arrows 1a and 1b in FIG. 12. As previously mentioned, the upward movement of slider 40 is limited by stop projection 48. Slider 40 may be then rotated, constraining by means of engagement of flanges 15*a* and 15*b* with grooves 16*a* and 16*b*, as viewed in FIG. 11, rotary member 10 to rotate therewith to the second rotary position. When the second rotary position is reached, slider 40 may be released to its engaging position viewed in FIG. 13. It would be obvious that markings may be placed on the top 45*a* to indicate the positions of jaws 23*a* and 23*b*. Slider 40 and rotary member 10 may be otherwise shaped to constrain them to rotate jointly.

In summary, the invention describes a rotary switch comprising a stationary and rotary members and a reciprocating slider. The rotary member includes an insulating body and a flexible conducting bridging element secured thereto. The stationary member includes an insulating body having a plurality of stationary contact pairs angularly arranged thereon. The rotary and stationary members are coupled for rotating the bridging element to one of a plurality of angular rotary positions aligned with a selective one of the contact pairs. A slider member is arranged on the rotary member for reciprocating movement to its engaging position, for deflecting the bridging element into electrical engagement with the aligned contact pair on the stationary member, and to its disengaging position, for releasing the bridging element from the aligned contact pair. In another embodiment is disclosed a rotary switch having a slider capable of rotation about an axis and a rotary member constrained to rotate with the slider.

It would be obvious that persons skilled in the art may resort to numerous modifications in the construction of the preferred embodiments shown herein, without departing from the spirit of the invention as defined in the appended claims.

What I claim is:

1. A rotary switch comprising:

a stationary member including an insulating body having a plurality of stationary contact pairs angularly arranged thereon;

a rotary member including a rotary body and a flexible conducting bridging element secured thereto;

said rotary body being coupled to said stationary member for rotating about an axis to bring said bridging element to one of a plurality of angular rotary positions aligned with a selective one of said contact pairs; and a slider member arranged on said rotary member for reciprocating movement along said axis to an engaging position, for deflecting said bridging element into electrical engagement with the aligned contact pair on said stationary member, and to a disengaging position, for releasing said bridging element from said aligned contact pair.

2. A rotary switch comprising:

a stationary member including an insulating body having a plurality of stationary contact pairs angularly arranged thereon;

a rotary member including a rotary body and a flexible conducting U-shaped bridging element secured thereto, said bridging element having two ends with integral gripping jaws;

said rotary body being coupled to said stationary member for rotating said bridging element to one of a plurality of angular rotary positions aligned with a selective one of said contact pairs; and a slider member arranged on said rotary member for reciprocating movement to an engaging position, for deflecting said jaws into electrical engagement with the aligned contact pair on said stationary member, and to a disengaging position, for releasing said jaws from said aligned contact pair.

3. A rotary switch comprising:

a stationary member including an insulating body having a plurality of stationary contact pairs angularly arranged thereon;

a rotary member including a rotary body and a flexible conducting U-shaped bridging element secured thereto, said bridging element having integral gripping jaws extending at its ends, said jaws having abutting surfaces formed on their outer faces;

said rotary body being coupled to said stationary member for rotating said bridging element to one of a plurality of angular rotary positions aligned with a selective one of said contact pairs; and a slider member having abutting surfaces for engaging the abutting surfaces on said jaws and being arranged on said rotary member for reciprocating movement to an engaging position, for deflecting said jaws into electrical engagement with the aligned contact pair on said stationary member, and to a disengaging position, for releasing said jaws from said aligned contact pair.

4. A rotary switch comprising:

a stationary member including an insulating body having a plurality of stationary contact pairs angularly arranged thereon;

a rotary member including a rotary body and a flexible conducting bridging element secured thereto, said rotary body having formed thereon a spring stop;

said rotary body being coupled to said stationary member for rotating said bridging element to one of a plurality of angular rotary positions aligned with a selective one of said contact pairs; and a slider member arranged on said rotary member for reciprocating movement to an engaging position, for deflecting said bridging element into electrical engagement with the aligned contact pair on said stationary member, and to a disengaging position, for releasing said bridging element from said aligned contact pair, said slider member having formed thereon an overhanging portion extending over said spring stop, thereby internally defining a spring cavity; and a spring located within said spring cavity, surrounding said rotary body, and interposed between said spring stop and said slider member for normally urging the latter to its engaging position.

5. A rotary switch comprising:

a stationary member including an insulating body having a plurality of stationary contact pairs angularly arranged thereon;

a rotary member including a rotary body and a flexible conducting bridging element secured thereto;

said rotary body being coupled to said stationary member for rotating about an axis to bring said bridging element to one of a plurality of angular rotary positions aligned with a selective one of said contact pairs;

said rotary member having formed thereon a flange extending along said axis;

a slider member arranged on said rotary member for reciprocating movement along said axis to an engaging position, for deflecting said bridging element into electrical engagement with the aligned contact pair on said stationary member, and to a disengaging position, for releasing said bridging element from said aligned contact pair, said slider member being free to rotate about said axis;

said slider member having formed therein a groove extending along said axis for slidably engaging said flange;

whereby said rotary member is constrained to rotate with said slider member.

6. A rotary switch comprising:

a stationary member including an insulating stationary body having a plurality of recesses formed in its surface and angularly arranged to form recess pairs, stationary contacts being respectively disposed in said recesses, thereby defining contact pairs in associated recess pairs;

a rotary member including a rotary body and a flexible conducting bridging element secured thereto;

said rotary body being coupled to said stationary member for rotating said bridging element to one of a plurality of angular rotary positions aligned with a selective one of said recess pairs;

a slider member arranged on said rotary member for reciprocating movement to an engaging position, for deflecting said bridging element into the aligned recess pair and into electrical engagement with the aligned contact pair on said stationary member, and to a disengaging position, for releasing said bridging element from said aligned contact pair and from said aligned recess pair.

* * * * *